US012746446B2

(12) United States Patent
Targosz

(10) Patent No.: US 12,746,446 B2
(45) Date of Patent: Sep. 29, 2026

(54) KICKING MOTION TRAINING DEVICE

(71) Applicant: Pea Eye Holdings, LLC, Farmington Hills, MI (US)

(72) Inventor: Adam D. Targosz, Farmington Hills, MI (US)

(73) Assignee: PEA EYE HOLDINGS LLC, Farmington Hills, MI (US)

( * ) Notice: Subject to any disclaimer, the term of this patent is extended or adjusted under 35 U.S.C. 154(b) by 238 days.

(21) Appl. No.: 18/607,982

(22) Filed: Mar. 18, 2024

(65) Prior Publication Data

US 2024/0316431 A1 Sep. 26, 2024

Related U.S. Application Data

(60) Provisional application No. 63/453,283, filed on Mar. 20, 2023.

(51) Int. Cl.
*A63B 69/00* (2006.01)

(52) U.S. Cl.
CPC ..... *A63B 69/0091* (2013.01)

(58) Field of Classification Search
CPC . A63B 69/0091; A63B 69/38; A63B 69/0084; A63B 69/002; A63B 2243/007
See application file for complete search history.

(56) References Cited

U.S. PATENT DOCUMENTS

| | | | | | |
|---|---|---|---|---|---|
| 410,475 | A * | 9/1889 | Widger | A63B 69/224 | 482/90 |
| 3,851,886 | A * | 12/1974 | Acosta | A63B 69/0091 | 473/139 |
| 9,682,300 | B2 * | 6/2017 | Connors | A63B 69/0079 | |
| 10,709,950 | B1 * | 7/2020 | Wilkins | A63B 69/0091 | |
| 10,729,961 | B2 * | 8/2020 | Ohle | A63B 69/002 | |
| 2015/0360107 | A1 * | 12/2015 | Achkar | A63B 69/0079 | 473/429 |

* cited by examiner

*Primary Examiner* — Michael D Dennis
(74) *Attorney, Agent, or Firm* — Darrow Mustafa PC

(57) ABSTRACT

In one example, a device includes a platform, a post attached to the platform, and a member rotatably attached to the post and configured to be attached to a ball. The platform is configured to support an individual when kicking the ball.

19 Claims, 6 Drawing Sheets

KICKING MOTION TRAINING DEVICE

CROSS-REFERENCE TO RELATED APPLICATION

The application claims priority to U.S. Provisional Patent No. 63/453,283, filed on Mar. 20, 2023, which is hereby incorporated by reference in its entirety.

TECHNICAL FIELD

The subject matter described herein relates, in general, to devices for training individuals in performing kicking motions, such as kicking motions performed while playing soccer, football, and the like.

BACKGROUND

The background description provided is to present the context of the disclosure generally. Work of the inventor, to the extent it may be described in this background section, and aspects of the description that may not otherwise qualify as prior art at the time of filing, are neither expressly nor impliedly admitted as prior art against the present technology.

Sports that involve a kicking motion, such as soccer, football, and the like, are usually played by having an individual interact with a ball by kicking it. While the general concept of kicking a ball with one's foot appears straightforward, the overall mechanics can be exceedingly complex. For example, in some cases, to properly kick a ball, one must lock their ankle, position their plant foot properly, and perform the appropriate motion that places their kicking foot in contact with the ball. This technique may not be rapidly developed and may require the individual to practice mastering the technique.

Typically, when practicing the kicking motion, the individual may kick the ball forward at distances, requiring the individual to retrieve the ball after every kicking action. This ball retrieving can be time-consuming and may dissuade the individual from practicing. Some solutions involve attaching the ball to a rope, which is then attached to an anchor. The anchor, in turn, is then inserted into the ground. When an individual kicks the ball attached to such a device, the ball's travel is restricted, reducing the retrieval distance. However, these solutions require the anchor to be inserted into the ground, which prohibits their use on hard surfaces, such as gymnasium floors, concrete, asphalt, carpet, tile, wood floors, etc.

SUMMARY

This section generally summarizes the disclosure and is not a comprehensive explanation of its full scope or all its features.

In one example, a device includes a platform, a post attached to the platform, and a member rotatably attached to the post and configured to be attached to a ball. The platform is configured to support an individual when kicking the ball.

Further areas of applicability and various methods of enhancing the disclosed technology will become apparent from the description provided. The description and specific examples in this summary are intended for illustration only and are not intended to limit the scope of the present disclosure.

BRIEF DESCRIPTION OF THE DRAWINGS

The accompanying drawings, which are incorporated in and constitute a part of the specification, illustrate various systems, methods, and other embodiments of the disclosure. It will be appreciated that the illustrated element boundaries (e.g., boxes, groups of boxes, or other shapes) in the figures represent one embodiment of the boundaries. In some embodiments, one element may be designed as multiple elements or multiple elements may be designed as one element. In some embodiments, an element shown as an internal component of another element may be implemented as an external component and vice versa. Furthermore, elements may not be drawn to scale.

DETAILED DESCRIPTION

Figure 1:
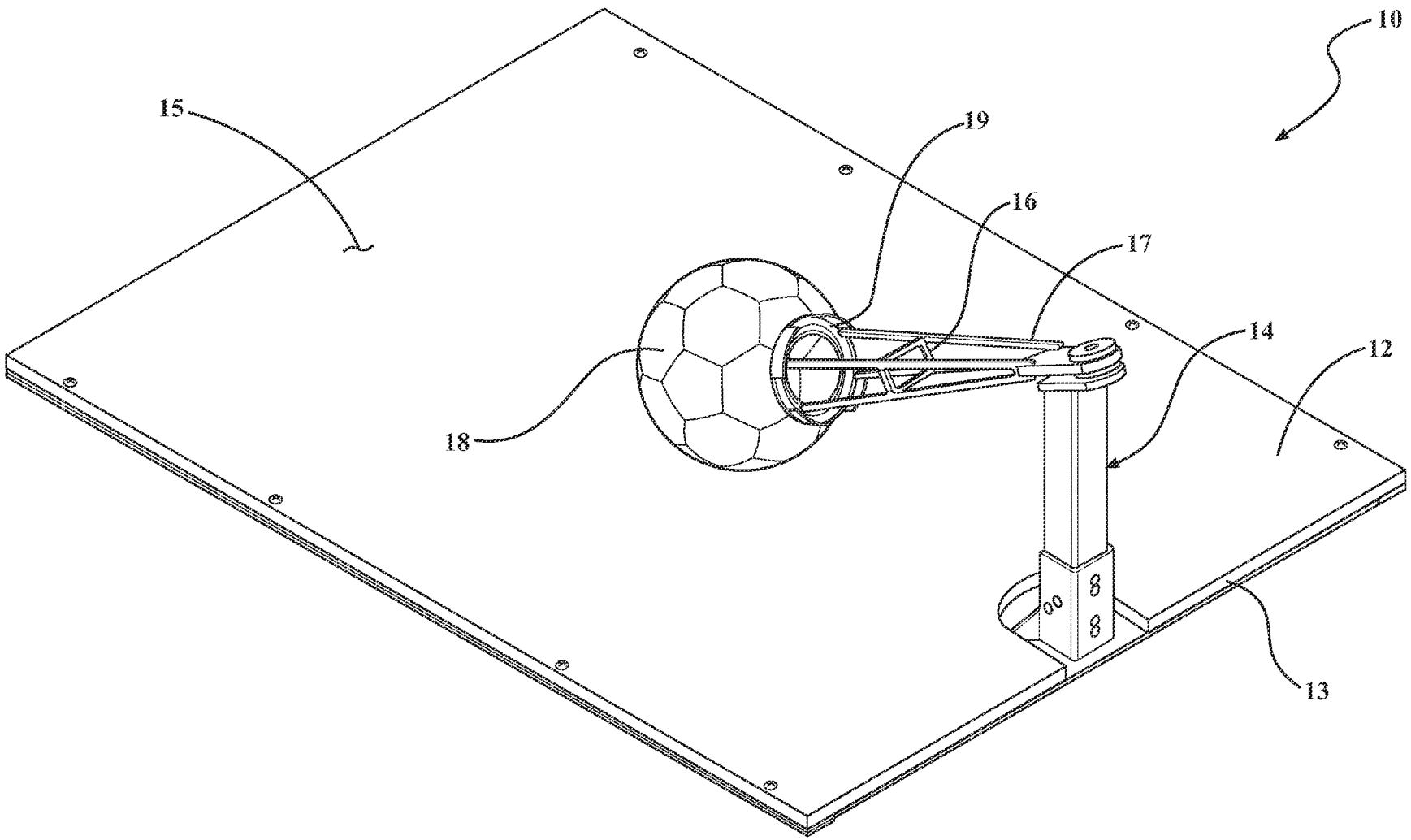
FIG. 1 illustrates a perspective view of a kicking motion training device.
Figure 2:
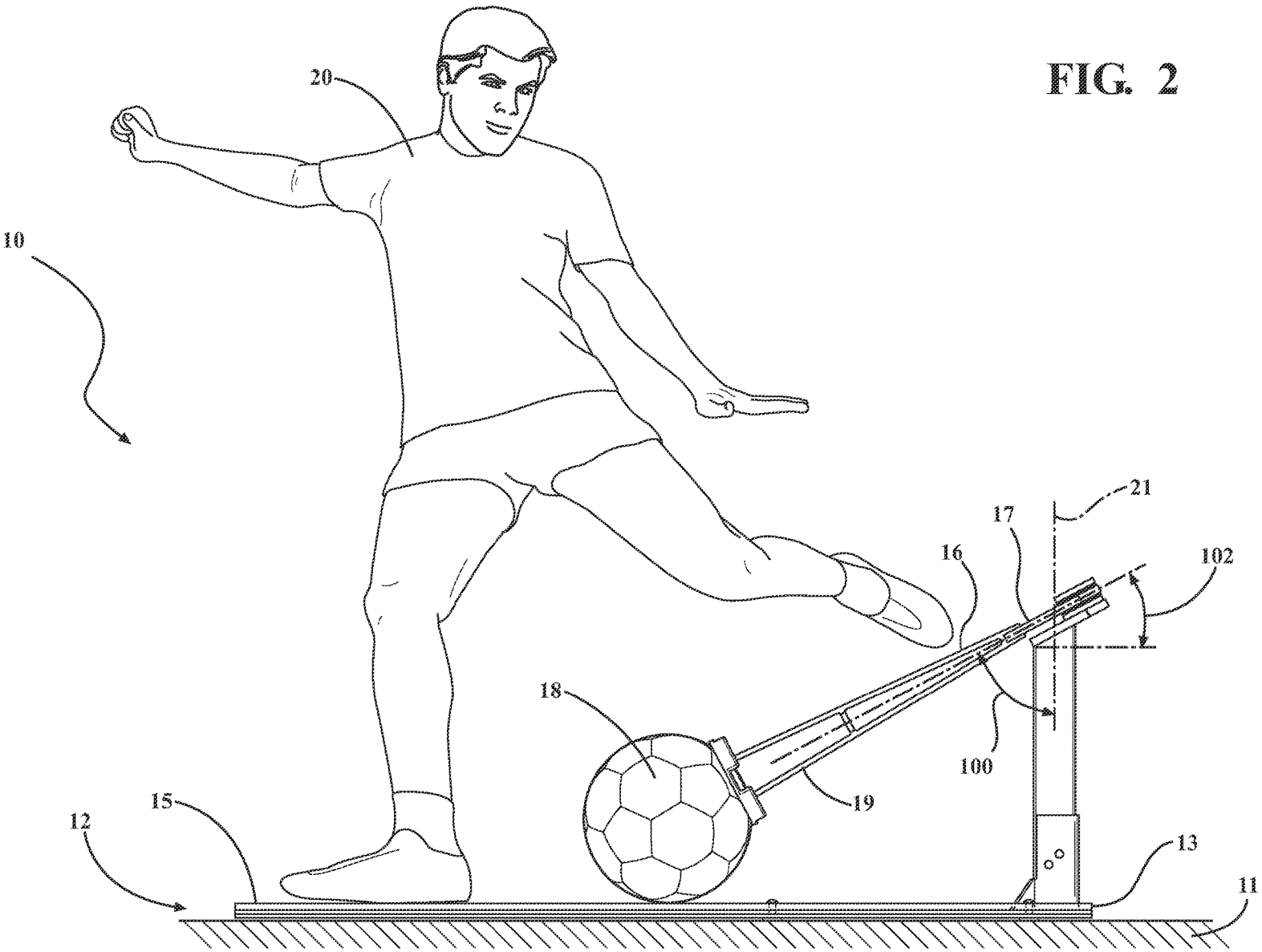
FIG. 2 illustrates another view of the kicking motion training device of FIG. 1, wherein an individual is in the process of kicking a ball of the kicking motion training device.

FIGS. 1 and 2 illustrate one example of a kicking motion training device 10 for allowing an individual 20 to practice their kicking. Moreover, the kicking motion training device 10 includes, in this example, a platform 12 that may be configured to rest on the support surface 11, such as the ground, some type of flooring, or any suitable support surface. The overall shape of the platform 12 can vary from application to application. In this example, the platform 12 is shown to be rectangular. However, it should be understood that the platform 12 can take other shapes as well, such as oval, circular, square, hexagonal, octagonal, triangular, etc.

A post 14 generally extends in an upward and perpendicular direction from a plane defined by the platform 12. Generally, the post 14 is located proximate to an edge 13 of the platform 12. As such, by placing the post 14 near an edge 13 of the platform 12, the platform 12 allows for a fairly large area 15 wherein an individual 20 may stand or perform a kicking motion when utilizing the kicking motion training device 10. As will be described later, the platform 12 may include a frame and may be covered with a material, such as a carpet or artificial turf, to mimic the surface of a playing field, such as a soccer field.

As will be described in greater detail later, rotatably attached to the post 14 is a member 16. The member 16, as will be described later, can take a number of different forms and may be made of a number of different materials. In one example, the member 16 may be rigid or may be substantially rigid to allow some flexibility. One end 17 of the member 16 is attached to the post 14, while the other end 19 is attached to a ball 18. Generally, the member 16 extends from near the top of the post 14 in a downward direction towards the platform 12. In one example, the angle 100, as defined by the length of the post 14 and the direction that the member 16 extends towards the platform 12 may be approximately 60 degrees, as shown. However, it should be understood that the angle 100 can vary from application to application. Nevertheless, the member 16 will extend in a downward direction from the post 14 toward the platform 12.

The ball 18 can take any one of a number of different forms. For example, the ball 18 may be a soccer ball, but the ball 18 could be an American football, Australian rules football, rugby ball, and the like. Moreover, the ball 18 could be any type of ball in which the foot of the individual 20 utilizing the kicking motion training device 10 could engage or otherwise come into contact. The ball 18, when connected to the member 16 when in a resting position, generally comes into contact with the platform 12 until the ball 18 is kicked by the individual 20.

The arrangement of the kicking motion training device 10, as described, allows for the individual 20 to be at least partially supported by the platform 12 when kicking the ball 18. Here, the kicking of the ball 18 by the individual 20 causes the ball 18 and the member 16 to rotate about an axis 21 at an angle 102, which is approximately 30° with respect to a line 22, which is perpendicular to a plane defined by the surface of the platform 12. It should be understood that the angle 102, like the angle 100, can vary from application to application.

For example, the individual 20 in FIG. 2 is in the process of kicking the ball 18. The weight of the individual 20 applies a downward force upon the platform 12, allowing the platform 12 to better frictionally engage with the support surface 11. As such, the weight of the individual 20 essentially allows the kicking motion training device 10 to stay in place as the individual 20 kicks the ball 18. Unlike the prior art that requires that a ball be anchored into a ground or other support surface, the kicking motion training device 10 does not require any type of insertion into the support surface 11 and can be, therefore, used in a variety of different hard surfaces, such as cement, tile, wood, and the like.

Figure 3:
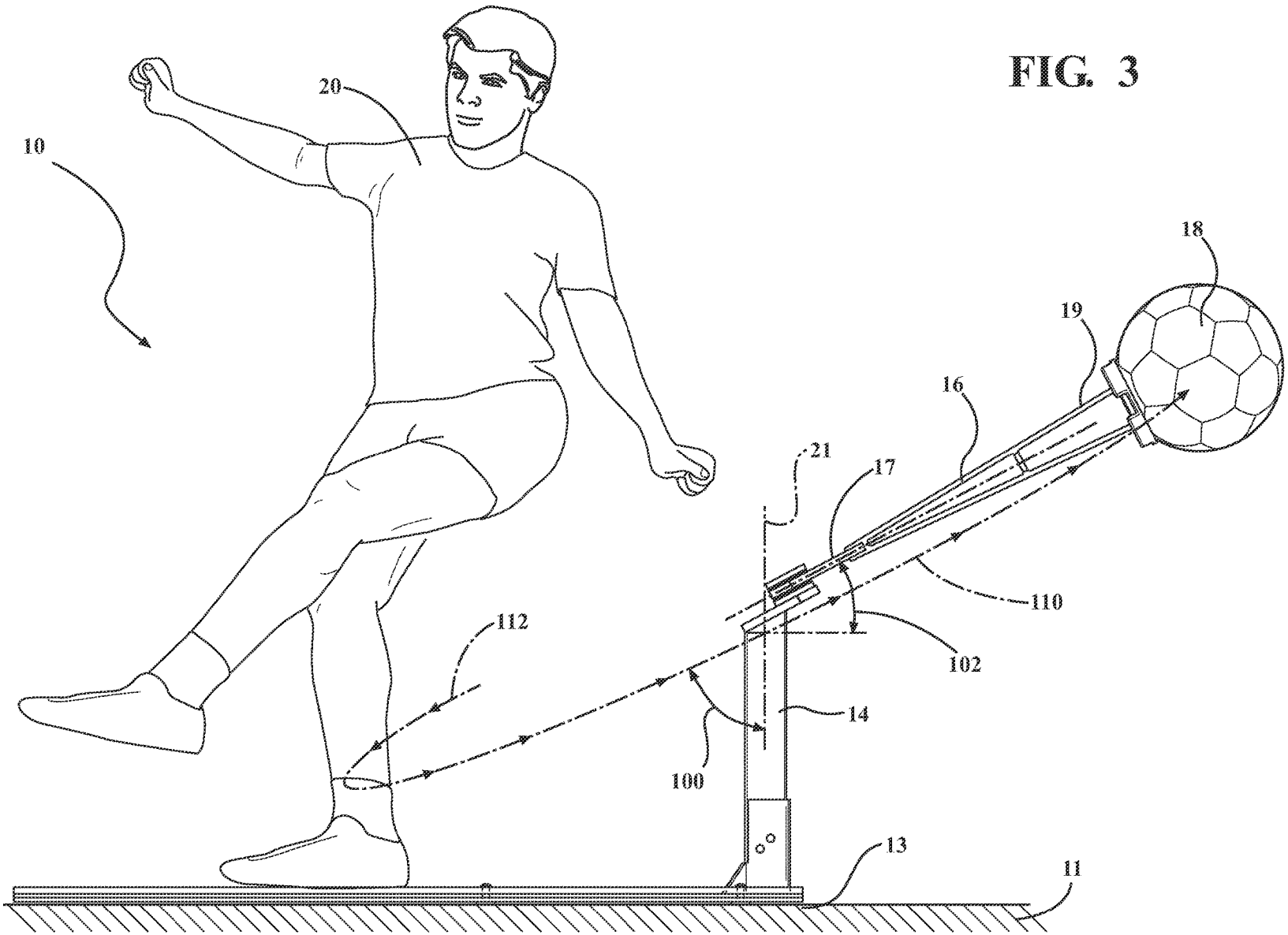
FIG. 3 illustrates another view of the kicking motion training device of FIG. 1, wherein an individual has recently kicked a ball of the kicking motion training device.

In FIG. 3, the individual 20 has just kicked the ball with a sufficient amount of force, causing the ball 18 and the member 16, to which the ball 18 is connected, to spin about the axis 21, shown by arrow 110. Assuming that the force caused by the kicking motion by the individual 20 of the ball 18 is significant enough, the ball 18 and the member 16 will complete at least one rotation about the axis 21, shown by arrow 112, and return to their resting position, as shown in FIG. 2. Moreover, having the ball 18 and the member 16 rotate about the axis 21 at the angle 102, allows gravity (and possibly force provided by the kicking action) to cause the ball 18 to return to its resting position on top of the platform 12. Once the ball 18 has returned to its resting position, the individual 20 may kick the ball again. This has another advantage over the prior art in that the particular arrangement of the kicking motion training device 10 allows the ball to return to a regular resting position. Prior art solutions typically allow the ball to spin freely about an anchor point and not return to a particular position, forcing an individual to reposition themselves to kick the ball again.

Figure 4:
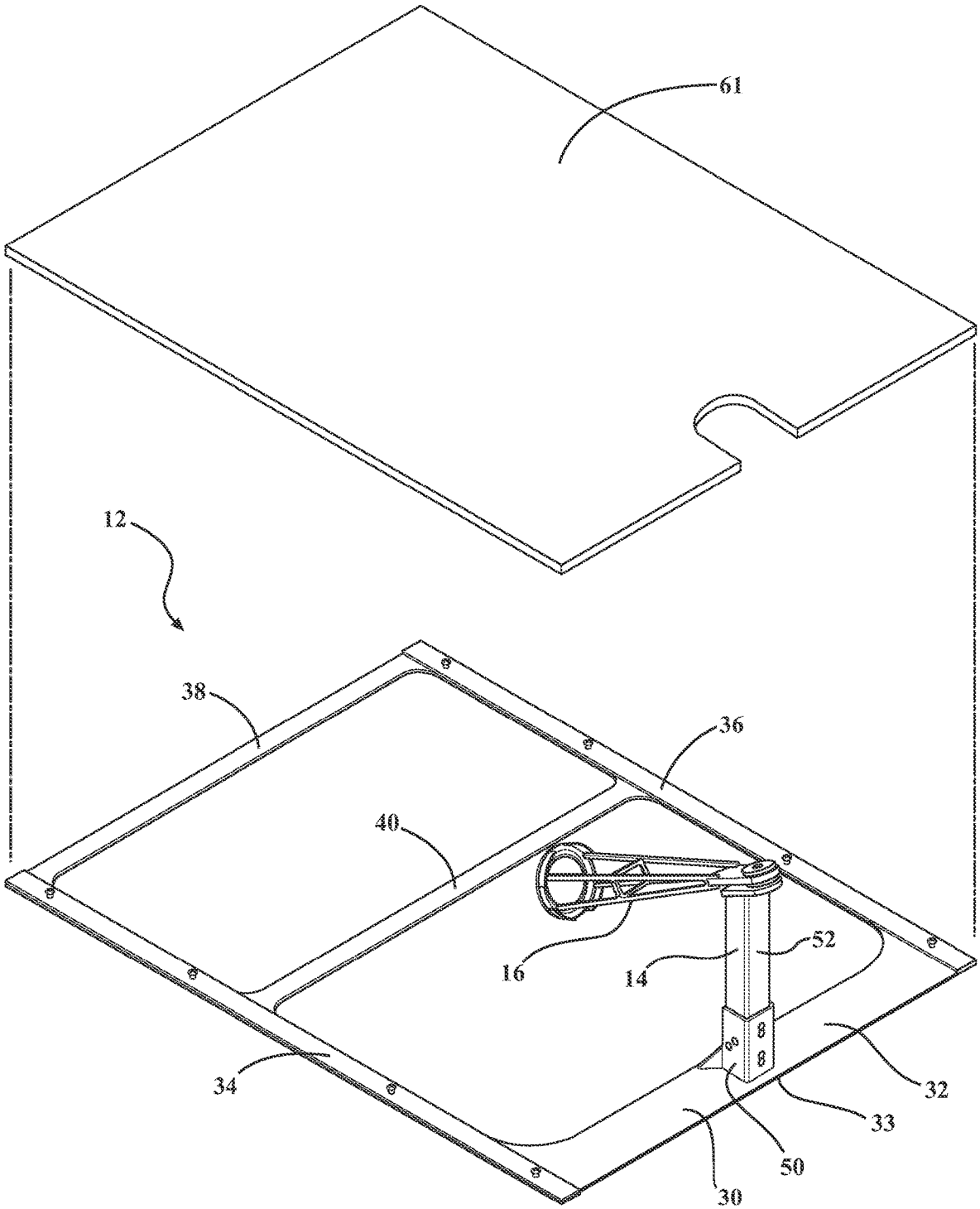
FIG. 4 illustrates a more detailed view of the platform of the kicking motion training device of FIG. 1.

Referring to FIG. 4, illustrated is an exploded view of the platform 12 of the kicking motion training device 10. For better viewability, the ball 18 has been removed from FIG. 4. It should be understood that the description of the platform 12 in this figure is but one example of how the platform 12 may be constructed. Here, the platform 12 may include a frame 30. The frame 30 may include crossbars 32, 38, and 40 and two longitudinal bars 34 and 36. In this example, the crossbars 32, 38, and 40 extend between the two longitudinal bars 34 and 36. Generally, the crossbars 32 and 38 may be located at opposite ends of the longitudinal bars 34 and 36. The crossbar 40 may be located and connected between the middle portions of the longitudinal bars 34 and 36.

In particular, the post 14 may be connected to the crossbar 32 at a location 33, which is a substantially equal distance between opposing ends of the crossbar 32. In this example, the post 14 may include a base 50 that is fixedly attached to the crossbar 32. A secondary member 52 may be inserted within the base 50, forming the post 14. In this example, the secondary member 52 is connected to the member 16 and, therefore, the ball 18. In particular, the secondary member 52 may be removed from the base 50 to allow easier transportation and/or storage of the kicking motion training device 10.

Figure 5:
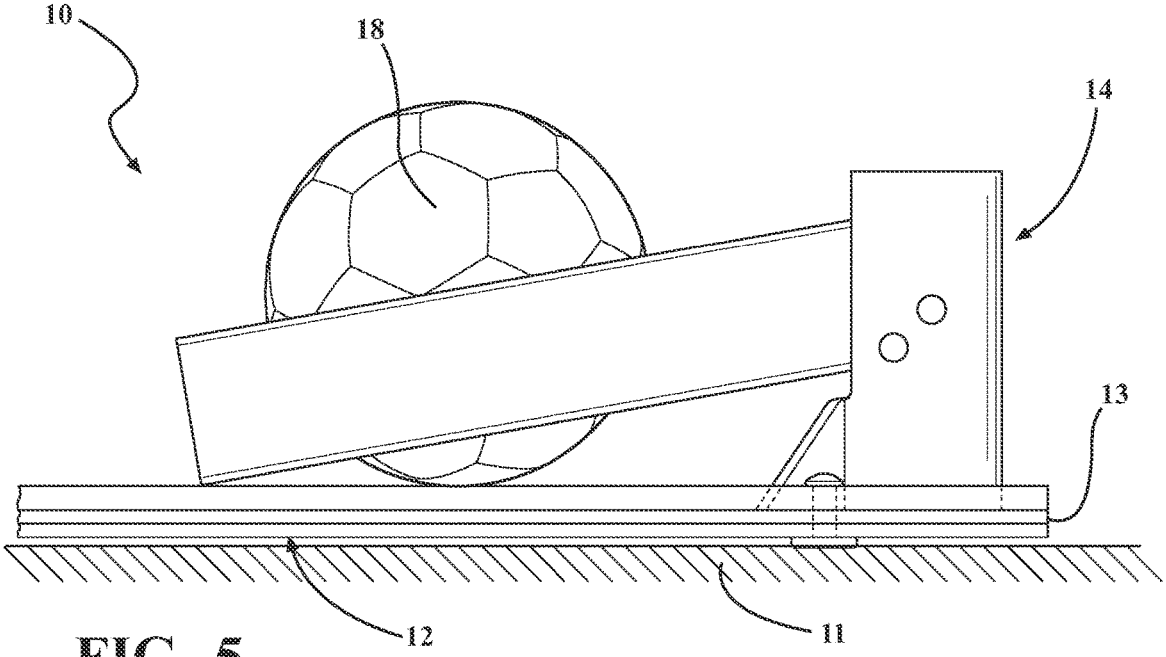
FIG. 5 illustrates an alternative embodiment of the kicking motion training device, wherein the post of the kicking motion training device can fold towards the platform, allowing for easier transportability and/or storage.

Alternatively, as best shown in FIG. 5, the secondary member 52 could be rotatably attached to the base 50, allowing the secondary member 52 to fold downward towards the platform 12, also aiding in transportation and/or storage. As such, when in the extended position, the post 14 extends perpendicularly from a plane defined by the platform 12 and, when in the retracted position, the post 14 extends in a direction substantially parallel to the plane defined by the platform 12.

With particular attention to FIG. 4, attached to the frame 30 may be a surface layer 61 that substantially covers the frame 30. The surface layer 61 can be made of any suitable material and may be made of one or more layers. In one example, the surface layer 61 may include carpet and/or artificial turf, such as AstroTurf® sold by Sport Group Holding GmbH of Burgheim, Germany or FieldTurf® sold by Tarkett S. A. of La Défense, France. The use of carpet and/or artificial turf may be particularly desirable as it may simulate the playing surface of an athletic field. The surface layer 61 may be retained to the frame 30 utilizing any one of a number of different methodologies. In one particular example, a flat-headed bolt with a threaded nut is used to retain the surface layer 61 to the frame 30.

Again, it should be understood that the platform 12 can take any one of a number of different forms other than those described above. For example, instead of utilizing a frame 30, the platform 12 can instead be made of one or more layers of material, such as a large portion of rectangular material sized and shaped accordingly. In one particular straightforward example, the platform 12 can be made out of a rectangular piece of plywood or other type of material instead of utilizing a frame, such as the frame 30.

Figure 6:
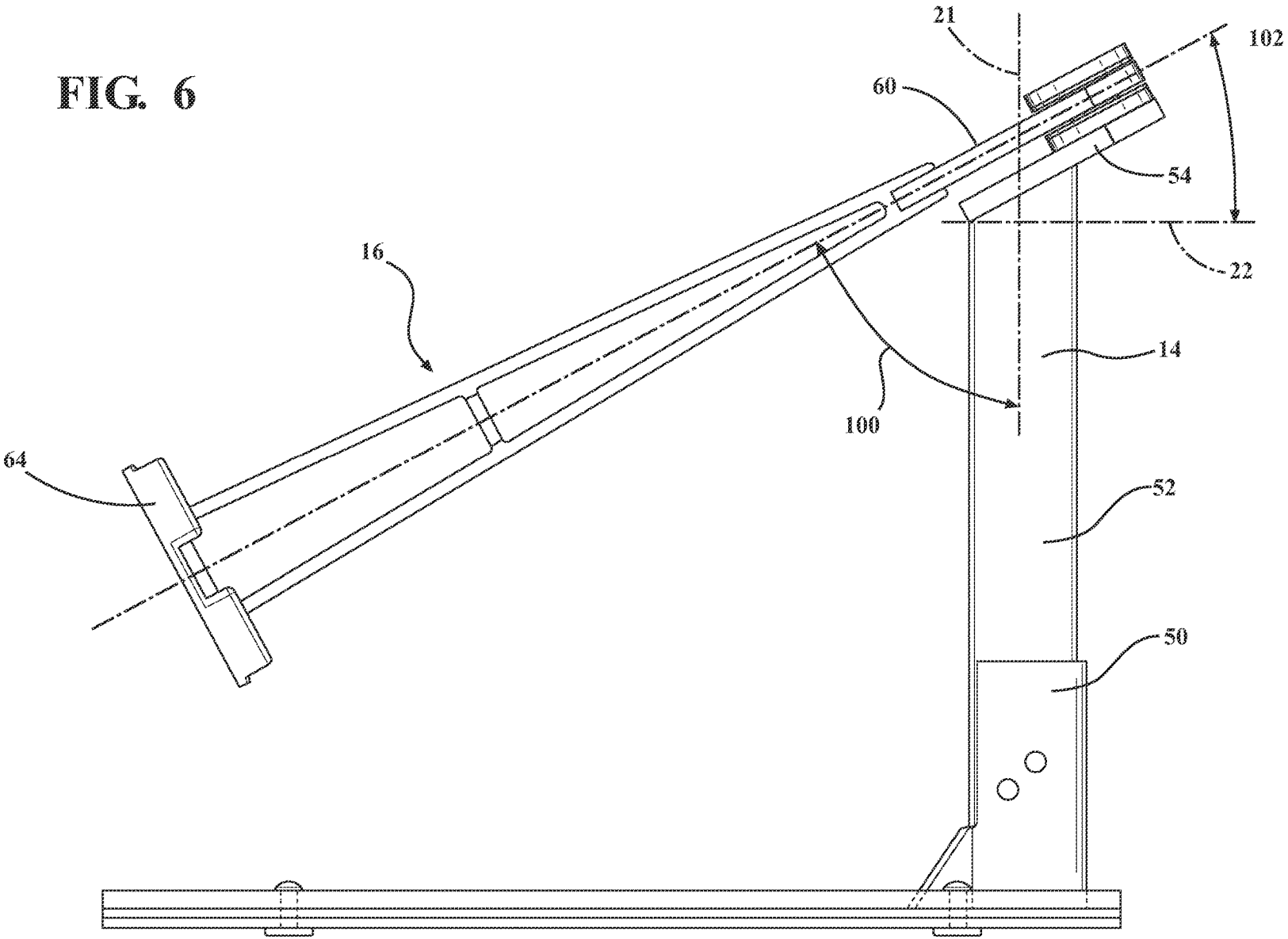
FIG. 6 illustrates a more detailed view of a post and a member that connects the ball to the post of the kicking motion training device of FIG. 1.

FIG. 6 illustrates a more detailed view of the member 16 and the post 14. In particular, the member 16, as mentioned previously, may be made of any suitable rigid and/or semi-rigid material. In one example, the member 16 includes a first end 60 that is located nearest to the post 14 and a second end 64 that can be connected to a ball, such as the ball 18 mentioned in the paragraphs above. In particular, the second end 64 may be shaped as a ring that can be connected to the ball 18. In particular, any one of a number of different connection methodologies for connecting the second end 64 to the ball 18 can be utilized, such as straps, adhesives, suction cups, etc. Furthermore, the second end 64 and the ball 18 may be a single unitary structure and may not require any form of connection methodology.

Figure 7:
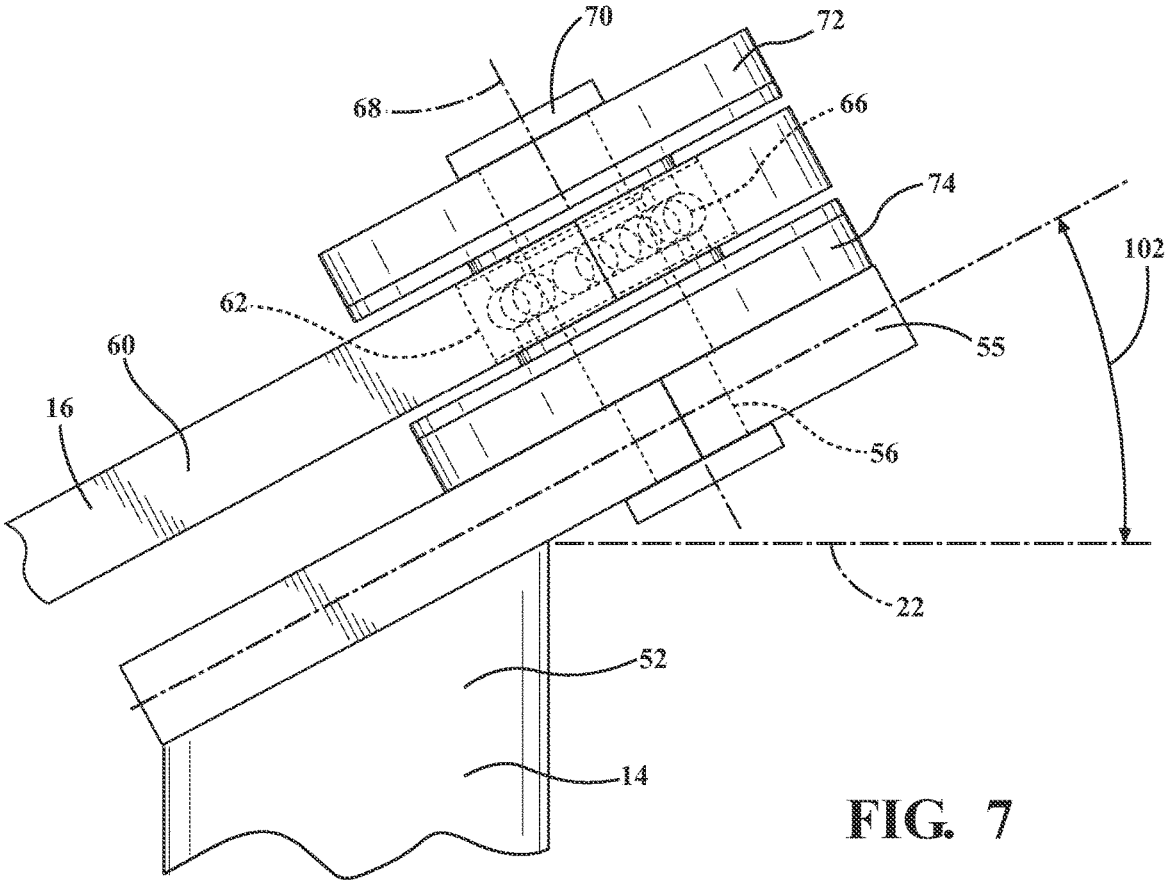
FIG. 7 illustrates a more detailed view of the rotatable connection between the post and the member of the kicking motion training device of FIG. 1.

Referring to FIG. 7, a more detailed view of how the member 16 is connected to the post 14 is shown. Here, as mentioned before, the post 14 may include a secondary member 52. The end of the secondary member 52 may include a top plate 54 having an extension 55 that extends in a direction generally away from the platform 12. In this example, the extension 55 extends along the angle 102 that was previously defined. As such, the angle 102 may be approximately 30°. However, it should be understood that the angle 102 may vary from application to application.

As mentioned before, the member 16 also includes a first end 60. Here, the first end 60 includes an eyelet 62 that extends through the first end 60. A ball bearing 66 may be disposed within the eyelet 62. The extension 55 also includes an eyelet 56 formed within. A fastener 70 may extend through both the eyelet 62 and the eyelet 56 and may rotatably attach the first end 60 to the extension 55. Moreover, the first end 60 (and the rest of the member 16), rotates about an axis 68, defined by the fastener 70. One or more washers, such as washers 72 and 74, may be located between portions of the fastener 70 and the first end 60 and/or the extension 55 to reduce friction as the first end 60 rotates around the axis 68.

Detailed embodiments are disclosed herein. However, it is to be understood that the disclosed embodiments are intended only as examples. Therefore, specific structural and functional details disclosed herein are not to be interpreted as limiting, but merely as a basis for the claims and as a representative basis for teaching one skilled in the art to variously employ the aspects herein in virtually any appropriately detailed structure. Further, the terms and phrases used herein are not intended to be limiting but rather to provide an understandable description of possible implementations.

The following includes definitions of selected terms employed herein. The definitions include various examples and/or forms of components that fall within the scope of a term, and that may be used for various implementations. The examples are not intended to be limiting. Both singular and plural forms of terms may be within the definitions.

References to "one embodiment," "an embodiment," "one example," "an example," and so on, indicate that the embodiment(s) or example(s) so described may include a particular feature, structure, characteristic, property, element, or limitation, but that not every embodiment or example necessarily includes that particular feature, structure, characteristic, property, element or limitation. Furthermore, repeated use of the phrase "in one embodiment" does not necessarily refer to the same embodiment, though it may.

The terms "substantially similar," "substantially equal," and the like, when used to compare one or more physical properties, may indicate a variance of up to 20% unless otherwise specified. The term such as "substantially," "about," "approximately," and the like when used to describe the measurement or some other physical property may indicate a variance of up to and including 25%, unless otherwise specified.

The terms "a" and "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The phrase "at least one of . . . and . . . " as used herein refers to and encompasses any and all possible combinations of one or more of the associated listed items. As an example, the phrase "at least one of A, B, and C" includes A only, B only, C only, or any combination thereof (e.g., AB, AC, BC, or ABC).

Aspects herein can be embodied in other forms without departing from the spirit or essential attributes thereof. Accordingly, reference should be made to the following claims, rather than to the foregoing specification, as indicating the scope hereof.

What is claimed is:

1. A device comprising:

a platform;

a post attached to the platform, wherein the post includes a top plate located at an end of the post that is opposite of the platform;

a member rotatably attached to the post and configured to be attached to a ball;

wherein the platform is configured to support an individual when kicking the ball; and wherein the top plate includes an extension that extends away from the platform at an angle that is approximately 30 degrees with respect to a plane that is defined by the platform.

2. The device of claim 1, wherein an angle defined between at least a portion of the member and the post is approximately 60 degrees.

3. The device of claim 1, wherein the member is rotatably connected to the extension of the top plate.

4. The device of claim 3, wherein:

the extension of the top plate includes a top plate eyelet that extends through the extension of the top plate; and an end of the member opposite of the ball includes a member eyelet that extends through the member.

5. The device of claim 4, further comprising a fastener extending through the top plate eyelet and the member eyelet for rotatably connecting the member to the extension of the top plate.

6. The device of claim 4, further comprising a ball-bearing disposed within the member eyelet.

7. The device of claim 1, wherein the ball is at least one of a soccer ball, an American football, an Australian rules football, and a rugby ball.

8. The device of claim 1, wherein the platform includes a frame having:

a primary crossbar that is connected to the post, the primary crossbar having a first end and a second end, wherein the post is connected to the primary crossbar at a location that is approximately equal distance between the first and second ends;

a first longitudinal bar extending from the first end of the primary crossbar in a direction that is substantially perpendicular to a length of the primary crossbar; and a second longitudinal bar extending from the second end of the primary crossbar in a direction that is substantially perpendicular to the length of the primary crossbar.

9. The device of claim 8, wherein the frame further comprises a secondary crossbar that is connected to the first longitudinal bar and the second longitudinal bar.

10. The device of claim 8, wherein the platform further includes a surface layer disposed at least partially on the frame.

11. The device of claim 10, wherein the surface layer is at least one of a carpet and an artificial turf.

12. The device of claim 1, wherein:

the post is rotatably attached to the platform, allowing the post to selectively move between a retracted position and an extended position;

when in the extended position, the post extends perpendicularly from a plane defined by the platform; and when in the retracted position, the post extends in a direction substantially parallel to the plane defined by the platform.

13. A device comprising:

a platform;

a post attached to the platform;

a ball attached to the post by a member, the member being rotatably attached to the post; and wherein the platform is configured to support an individual when kicking the ball; and wherein an angle defined between at least a portion of the member and the post is approximately 60 degrees; and wherein the post includes a top plate located at an end of the post that is opposite of the platform, wherein the top plate includes an extension that extends away from the platform at an angle that is approximately 30 degrees with respect to a plane that is defined by the platform.

14. The device of claim 13, wherein:

the extension of the top plate includes a top plate eyelet that extends through the extension of the top plate; and an end of the member opposite of the ball includes a member eyelet that extends through the member.

15. The device of claim 14, further comprising a fastener extending through the top plate eyelet and the member eyelet for rotatably connecting the member to the extension of the top plate.

16. The device of claim 15, further comprising a ball-bearing disposed within the member eyelet.

17. The device of claim 13, wherein the ball is at least one of a soccer ball, an American football, an Australian rules football, and a rugby ball.

18. The device of claim 13, wherein the platform includes a frame having:

a primary crossbar that is connected to the post, the primary crossbar having a first end and a second end, wherein the post is connected to the primary crossbar at a location that is approximately equal distance between the first and second ends;

a first longitudinal bar extending from the first end of the primary crossbar in a direction that is substantially perpendicular to a length of the primary crossbar; and a second longitudinal bar extending from the second end of the primary crossbar in a direction that is substantially perpendicular to the length of the primary crossbar.

19. The device of claim 18, wherein the frame further comprises a secondary crossbar that is connected to the first longitudinal bar and the second longitudinal bar.

* * * * *